US008376705B1

(12) United States Patent
Liang et al.

(10) Patent No.: US 8,376,705 B1
(45) Date of Patent: Feb. 19, 2013

(54) TURBINE ENDWALL WITH GROOVED RECESS CAVITY

(75) Inventors: George Liang, Palm City, FL (US); Zhihong Gao, Orlando, FL (US); Brian J. Wessell, Orlando, FL (US); Joseph B. Gilliam, Deltona, FL (US)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 13/228,516

(22) Filed: Sep. 9, 2011

(51) Int. Cl.
*F01D 5/18* (2006.01)

(52) U.S. Cl. ..... 416/95; 415/115; 416/97 R; 416/189; 416/193 A

(58) Field of Classification Search ..... 415/115; 416/95, 97 R, 189, 193 A
See application file for complete search history.

(56) References Cited

U.S. PATENT DOCUMENTS 3,628,880 A * 12/1971 Smuland et al. ..... 415/175
3,800,864 A 4/1974 Hauser et al.
4,012,167 A 3/1977 Noble
4,017,213 A 4/1977 Przirembel
4,305,696 A 12/1981 Pask
4,353,679 A 10/1982 Hauser
5,197,852 A 3/1993 Walker et al.
5,252,026 A * 10/1993 Shepherd ..... 415/115
5,344,283 A 9/1994 Magowan et al.
5,609,466 A * 3/1997 North et al. ..... 415/115
5,975,851 A 11/1999 Liang
6,602,050 B1 8/2003 Scheurlen et al.
7,229,245 B2 6/2007 Ellis et al.
7,293,957 B2 11/2007 Ellis et al.
7,534,088 B1 * 5/2009 Alvanos et al. ..... 416/97 R
7,695,247 B1 4/2010 Liang
8,240,981 B2 * 8/2012 Spangler et al. ..... 415/115
2010/0129196 A1 5/2010 Johnston et al.
2010/0150710 A1 6/2010 Khanin et al.

* cited by examiner

*Primary Examiner* — Igor Kershteyn
*Assistant Examiner* — Christopher R Legendre

(57) ABSTRACT

A vane assembly for a gas turbine engine including an endwall and an airfoil extending from the endwall. An inner rail extends radially inwardly of the endwall, and an overhang portion extends axially from a location of the inner rail to a downstream edge. A recess cavity is defined in the overhang portion between the inner rail and the downstream edge. The recess cavity extends radially into the overhang portion and defines a cavity surface. A plurality of grooves extend radially into the cavity surface and have an elongated dimension extending in a direction from the inner rail toward the downstream edge. A plurality of cooling passages extend axially through the overhang portion, and are located between the grooves.

18 Claims, 5 Drawing Sheets

TURBINE ENDWALL WITH GROOVED RECESS CAVITY

FIELD OF THE INVENTION

The present invention relates generally to gas turbine engines and, more particularly, to a cooling configuration for cooling an endwall of a component, such as a vane assembly, in a gas turbine engine.

BACKGROUND OF THE INVENTION

In gas turbine engines, compressed air discharged from a compressor section and fuel introduced from a source of fuel are mixed together and burned in a combustion section, creating combustion products defining a high temperature working gas. The working gas is directed through a hot gas path in a turbine section, where the working gas expands to provide rotation of a turbine rotor. The turbine rotor may be linked to an electric generator, wherein the rotation of the turbine rotor can be used to produce electricity in the generator.

In view of high pressure ratios and high engine firing temperatures implemented in modern engines, certain components, such as airfoil assemblies, e.g., stationary vane assemblies and rotating blade assemblies within the turbine section, must be cooled with cooling fluid, such as compressor discharge air, to prevent overheating of the components and to reduce thermal stress in the components.

SUMMARY OF THE INVENTION

In accordance with an aspect of the invention, a component is provided in a gas turbine engine. The component comprises an airfoil extending radially outwardly from a endwall associated with the airfoil. The endwall extends between an upstream edge and a downstream edge and defines a cool side and a gas side. A recess cavity is defined in an overhang portion extending from a location adjacent to the downstream edge toward the upstream edge. The recess cavity extends radially into the overhang portion from the cool side toward the gas side and defines a cavity surface. A plurality of grooves extend radially into the cavity surface and have an elongated dimension extending in a direction from the downstream edge toward the upstream edge.

In accordance with yet further aspects of the invention, the endwall may include opposing lateral sides extending in an axial direction between the upstream and downstream edges, and the recess cavity may extend circumferentially between the lateral sides of the endwall. Additionally, the plurality of grooves may be spaced circumferentially across the recess cavity.

The endwall may comprise a radially inner endwall and may include an inner diameter endwall post-impingement cooling chamber located adjacent to the recess cavity. A plurality of cooling passages may be provided extending from the inner diameter endwall post-impingement cooling chamber to the downstream edge. Each of the cooling passages may extend through the overhang portion and may be located between a pair of the grooves. A radially extending raised portion of the recess cavity, between each pair of grooves, may include one of the cooling passages. An inner rail may be provided extending generally circumferentially between the inner diameter endwall post-impingement cooling chamber and the recess cavity, and the cooling passages may extend through the inner rail.

The cavity surface may be located a first distance into the endwall from a peripheral radially inner surface of the endwall, and the grooves may include a groove bottom surface located a second distance radially into the endwall greater than the first distance. The cooling passages may be located radially between the groove bottom surface and the cavity surface.

The airfoil may comprise a leading edge and a trailing edge, and the trailing edge of the airfoil may be joined to the gas side of the endwall at an axial location aligned with a portion of the recess cavity.

In accordance with another aspect of the invention, a vane assembly is provided for a gas turbine engine. The vane assembly comprises an inner endwall extending between an upstream edge and a downstream edge, and defining a cool side and a gas side. An outer endwall is spaced radially outward of the inner endwall, and an airfoil extends from the inner endwall to the outer endwall and includes a leading edge and a trailing edge. An inner rail extends generally circumferentially along the inner endwall and radially inwardly of the cool side of the inner endwall. The inner endwall includes an overhang portion extending axially from a location of the inner rail. A recess cavity is defined between the inner rail and the downstream edge. The recess cavity extends radially into the overhang portion from the cool side toward the gas side and defines a cavity surface. A plurality of grooves extend radially into the cavity surface and have an elongated dimension extending in a direction from the inner rail toward the downstream edge.

Additionally, the inner endwall may include an inner diameter endwall post-impingement cooling chamber located adjacent to the recess cavity. A plurality of cooling passages may be provided extending from the inner diameter endwall post-impingement cooling chamber to the downstream edge, and the cooling passages may extend through the inner rail.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
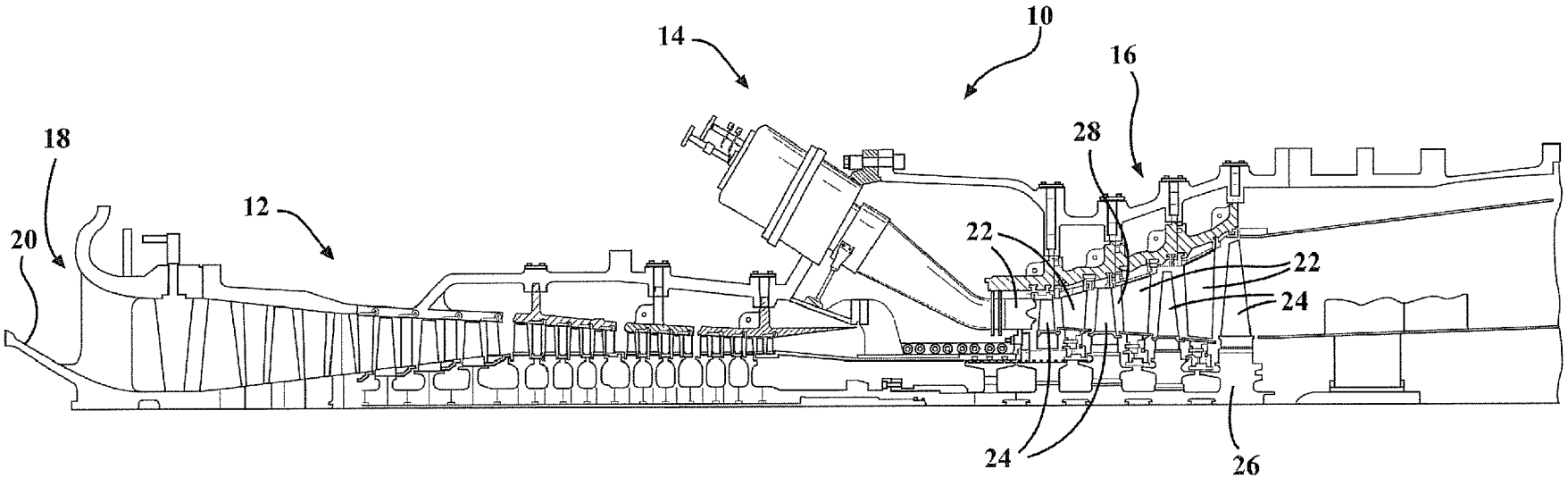
FIG. 1 is a partial cross-sectional view of a gas turbine engine incorporating a vane assembly formed in accordance with aspects of the present invention.

Referring to FIG. 1, a gas turbine engine 10 is illustrated including a compressor section 12, a combustor 14, and a turbine section 16. The compressor section 12 compresses ambient air 18 that enters an inlet 20. The combustor 14 combines the compressed air with a fuel and ignites the mixture creating combustion products comprising a hot working gas defining a working fluid. The working fluid travels to the turbine section 16. Within the turbine section 16 are rows of stationary vanes 22 and rows of rotating blades 24 coupled to a rotor 26, each pair of rows of vanes 22 and blades 24 forming a stage in the turbine section 16. The rows of vanes 22 and rows of blades 24 extend radially into an axial flow path 28 extending through the turbine section 16. The working fluid expands through the turbine section 16 and causes the blades 24, and therefore the rotor 26, to rotate. The rotor 26 extends into and through the compressor 12 and may provide power to the compressor 12 and output power to a generator (not shown).

Figure 2:
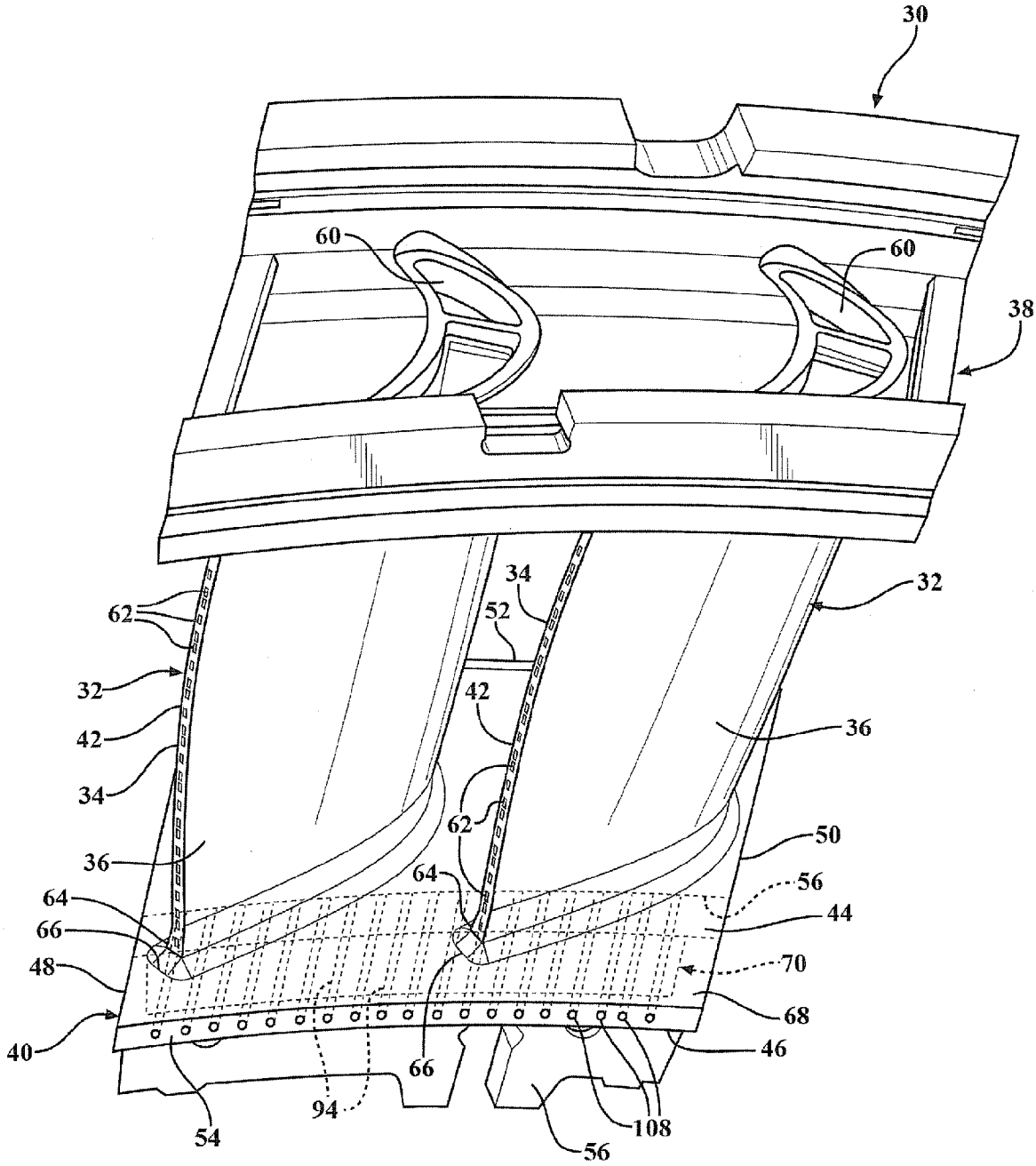
FIG. 2 is a perspective view of a vane assembly for a gas turbine incorporating aspects of the present invention.

Referring to FIG. 2, an airfoil structure 30 comprising two of the vanes of the row of vanes 22 is illustrated for the purpose of describing aspects of the present invention. However, it should be understood that the following description is not limited to implementation on an airfoil structure comprising a vane, and the described aspects of the invention may be implemented on other airfoil structures, such as may be implemented on a blade of the row of blades 24.

Further, it should be understood that the terms "inner", "outer", "radial", "axial", "circumferential", and the like, as used herein, are not intended to be limiting with regard to an orientation or particular use of the elements recited for aspects of the present invention.

The airfoil structure 30 may comprise a vane assembly including first and second airfoils or vanes 32 adapted to be supported to extend radially across the flow path 28. The vanes 32 each include a generally concave sidewall 34 defining a pressure side of the vane 32, and include an opposing generally convex sidewall 36 defining a suction side of the vane 32. The sidewalls 34, 36 extend radially between an outer diameter endwall 38 and an inner diameter endwall 40, and extend generally axially in a chordal direction between a leading edge (not seen in FIGS. 2-5) and a trailing edge 42 of each of the vanes 32. The endwalls 38, 40 are located at opposing ends of the vanes 32 and are positioned at locations where they form a boundary, i.e., outer and inner boundaries, defining a portion of the flow path 28 for the working fluid.

Figure 3:
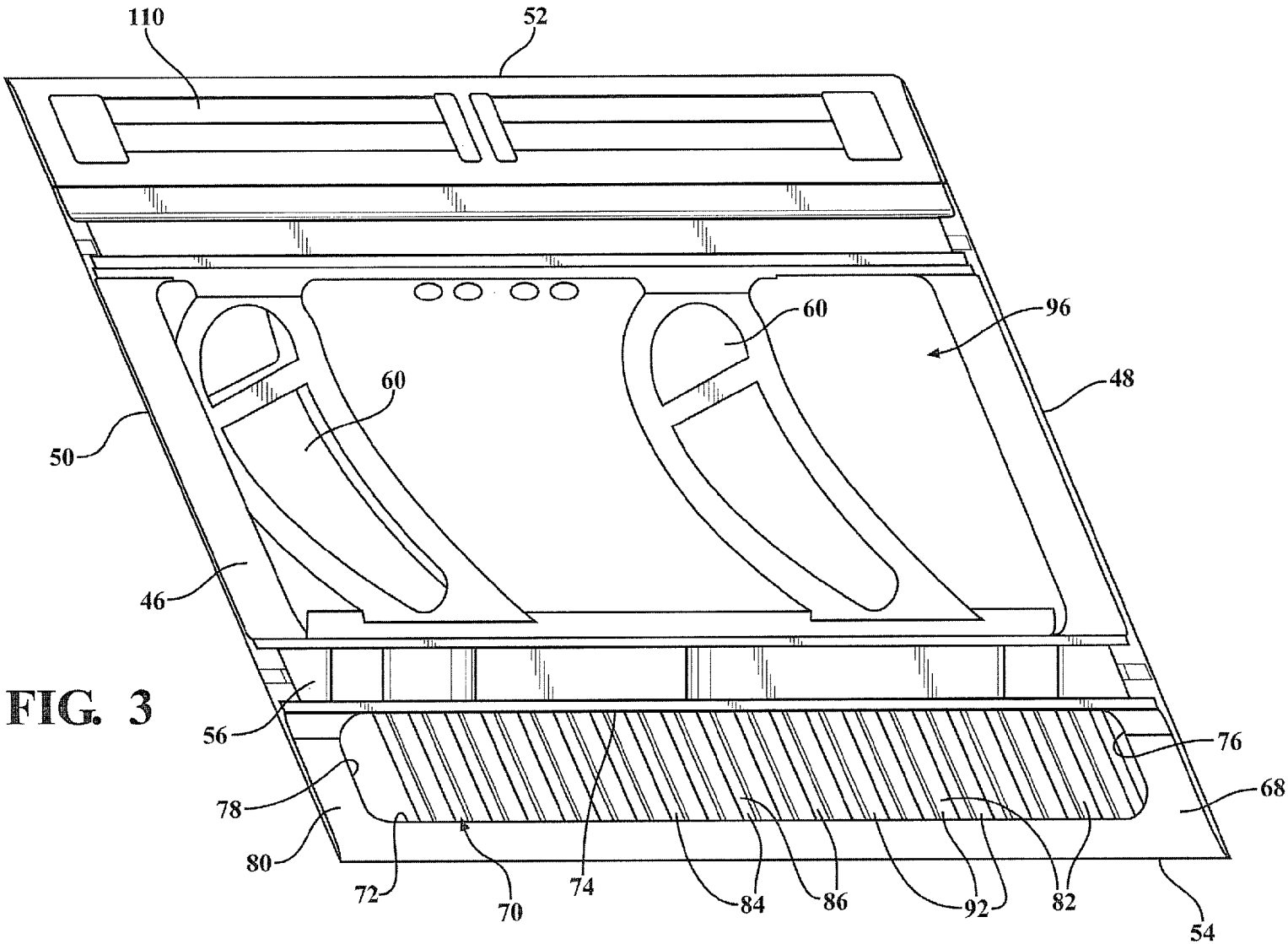
FIG. 3 is a perspective view of the vane assembly viewed from an inner diameter side of the vane assembly.
Figure 4:
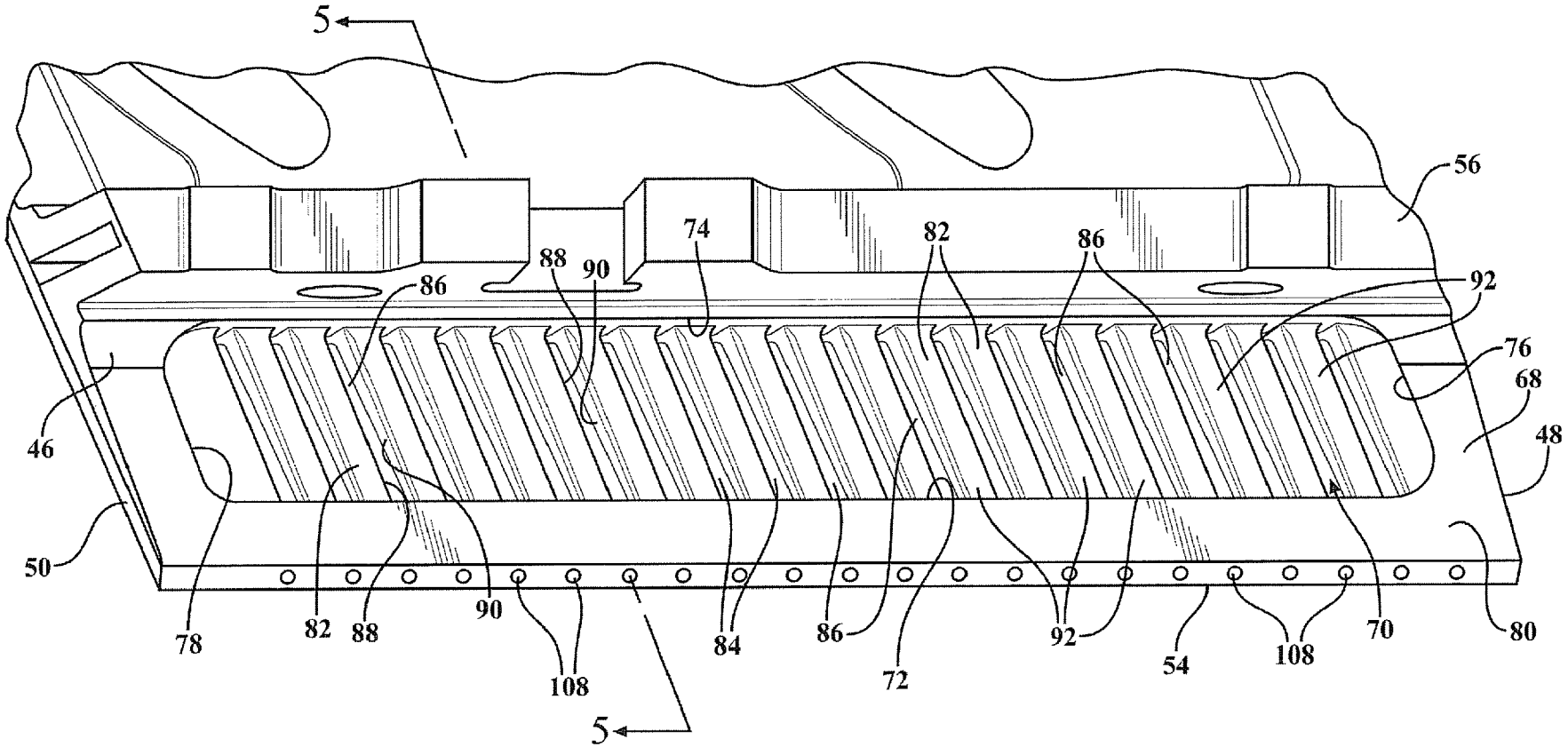
FIG. 4 is an enlarged detail perspective view of a recess portion of the vane assembly shown in FIG. 3.

The inner endwall 40 includes a gas or hot side 44 facing radially outwardly toward the flow path 28, and a cool side 46 facing radially inwardly toward the center of the turbine engine 10. The hot side 44 and cool side 46 of the inner endwall 40 extend circumferentially between opposing lateral sides 48, 50 of the endwall 40, and the lateral sides 48, 50 extend axially between an upstream edge 52 and a downstream edge 54 of the inner endwall 40. As seen in FIGS. 3 and 4, the airfoil structure 30 may further include an inner rail 56 extending generally circumferentially along the inner endwall 40 and extending radially inwardly of the cool side 46 of the inner endwall 40 for retaining the airfoil structure 30 in position at a radially inner location.

As seen in FIG. 2, the vanes 32 may be provided with radially extending cooling channels 60 for providing cooling to the side walls 34, 36 and the leading and trailing edges (only trailing edges 42 shown). The trailing edges 42 may be provided with a plurality of trailing edge cooling slots 62 spaced radially along the trailing edge 42 to provide convective cooling to the trailing edge 42.

It may be noted that, due to migration of hot gases along the vanes 32 radially inwardly from the radially outer portions toward the radially inner portions of the vanes 32, joints between the vanes 32 and the inner endwall 40 defined at fillet portions 64 adjacent to the aft portions of the vanes 32, i.e., adjacent to the trailing edges 42, experience elevated temperatures. That is, due to a trailing edge wake effect of the hot gases flowing past the vanes 32, the temperature of the aft fillet portions 64 may be substantially greater than temperatures radially outwardly from the inner endwall 40 and axially forward of the trailing edges 42. It is normally anticipated that an increased thermal stress will exist in the region where the trailing edge 42 meets the endwall 40, and it has generally been the practice to not provide the trailing edge cooling slots 62 in the areas of the trailing edges 42 closely adjacent to the endwall 40 in order to provide sufficient material to withstand the thermal stress. As a result, it has been difficult to provide effective convective cooling to the region of the junction between the trailing edge 42 and the endwall 40, i.e., at a trailing edge corner 66, which may be a further contributing factor in the formation of thermal stress at this location. In addition, different convective cooling mechanisms are provided to the endwall 40 and to the vanes 32, resulting in a differential cooling of these components which, in combination with a difference in the mass distribution of the metal forming the trailing edge corner 66 relative to the thicker or more massive endwall, may result in a substantial thermally induced strain at the trailing edge corner 66 during transient thermal cycles.

In accordance with an aspect of the invention, an overhang portion 68 of the inner endwall 40 may be configured to reduce thermal stress at the trailing edge corner 66, such as during transient thermal cycles. Referring to FIGS. 3 and 4, the overhang portion 68 generally comprises a portion of the inner endwall 40 that extends axially upstream from the downstream edge 54 toward the upstream edge 52. In particular, the overhang portion 68 extends between the downstream edge 54 and a location at or adjacent to the inner rail 56, generally corresponding to the location of the trailing edge corner 66.

The overhang portion 68 may be provided with a recess cavity 70 extending from a downstream boundary 72, adjacent to and axially spaced from the downstream edge 54, toward the upstream edge 52. The recess cavity 70 may have an upstream boundary 74 extending circumferentially and located adjacent to the inner rail 56. The recess cavity 70 may additionally extend circumferentially between lateral boundaries 76, 78 located adjacent to and circumferentially spaced from the lateral edges 48, 50. A remaining portion of the cool side 46 at the overhang portion 68 defines a peripheral radially inner surface 80 surrounding the recess cavity 70.

Figure 5:
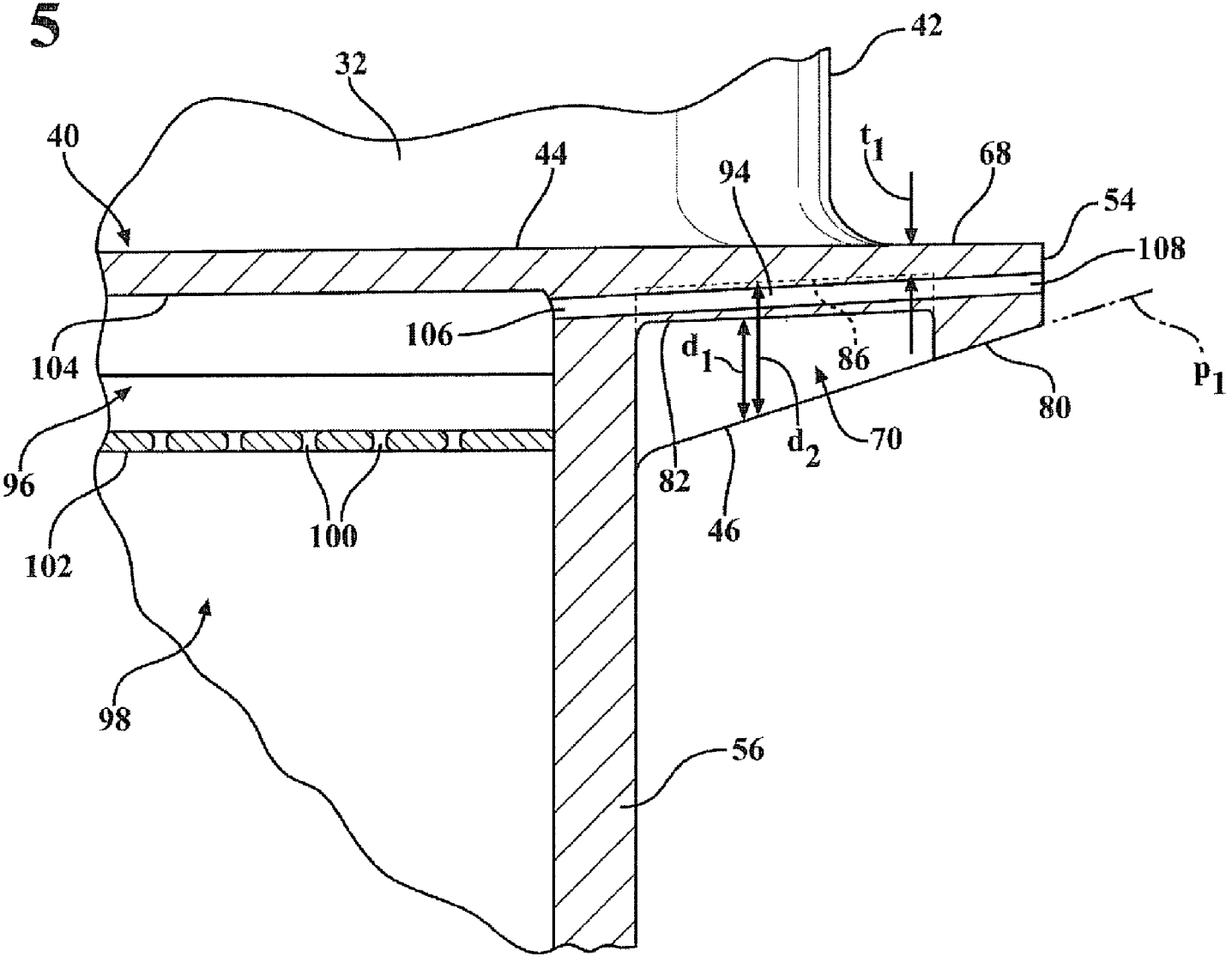
FIG. 5 is a cross-sectional view taken along line 5-5 in FIG. 4, and including an impingement plate.

The recess cavity 70 is generally defined by a hollowed out area formed in the cool side 46 of the inner endwall 40, and includes a cavity surface 82 spaced radially outwardly from a plane $p_1$ (FIG. 5) defined by the peripheral radially inner surface 80. As seen in FIG. 5, the recess cavity 70 extends radially into the overhang portion 68 a first distance $d_1$, measured radially from a peripheral radially inner surface 80 to the cavity surface 82. A plurality of grooves 84 extend radially into the cavity surface 82, and extend in the axial direction from the downstream edge 54 toward the upstream edge 52. Each of the grooves 84 include a groove bottom surface 86 located a second distance $d_2$ radially into the endwall, as measured from the peripheral radially inner surface 80, that is greater than the first distance $d_1$. It should be noted that peripheral radially inner surface 80, or the plane $p_1$ defined by the peripheral radially inner surface 80, may extend at an angle extending radially inwardly from the downstream edge 54 toward the upstream edge 52, as may be seen in FIG. 5. Accordingly, the comparative first and second distances $d_1$, $d_2$ referred to herein are distances measured at substantially the same axial location, and the values of distances $d_1$, $d_2$ may comprise varying distances, i.e., varying with axial location of the measurement, due to the angle of the cool side 46 at the overhang portion 68.

As seen in FIG. 4, the grooves 84 are defined by opposing radially extending surfaces 88, 90 extending between the cavity surface 82 and the groove bottom surface 86. The cavity surface 82 and associated pairs of the radially extending surfaces 88, 90 define radially extending raised portions, or ridges 92, within the recess cavity 70 wherein the ridges 92 and grooves 84 alternate through the recess cavity 70. The width of the ridges 92 may be substantially the same as or greater than the width of the grooves 84.

Referring to FIGS. 2 and 5, cooling passages 94 may extend through the overhang portion 68. The cooling passages 94 are illustrated as being located between pairs of the grooves 84, and extend within the ridges 92. Further, the cooling passages 94 are located radially between the groove bottom surface 86 and the cavity surface 82, such that all or a portion of each of the passages 94 is located radially inwardly beyond the groove bottom surface 86. The grooves 84 extending into the recess cavity 70 the distance $d_2$ provide a substantially thinned mass of material between the groove bottom surface 86 and the surface of the endwall 40 defined by the hot side 44, as depicted by thickness $t_1$ in FIG. 5. The thickness $t_1$ is preferably substantially constant along the axial length of the recess cavity 70, as well as at circumferential locations across the recess cavity 70.

It should be noted that the ridges 92 provide sufficient material for defining the cooling passages 94, while the grooves 84 minimize or reduce an amount of material in the recess cavity 70 extending on either side of and surrounding the cooling passages 94. Removal of material of the endwall 40 to form the recess cavity 70 reduces the structural rigidity of the endwall 40, and particularly reduces the rigidity or structural stiffness of the overhang portion 68 adjacent to the trailing edge 42 of the vanes 32. Additionally, removal of the material between the cooling passages 94 to form the grooves 84 further reduces the structural rigidity of the overhang portion 68. Hence, the mass of material of the endwall 40 adjacent to the trailing edges 42 of the vanes 32 at the trailing edge corners 66 is reduced permitting a greater degree of flexure in the endwall 40, effecting a reduced material strain at this location. It should also be noted that the reduced mass of material associated with the cooling passages, i.e., in the area of the grooves 84 and ridges 92, permits greater cooling effectiveness from the cooling passages 94 which may reduce the cooling differential between the convective cooling provided in the airfoils 32 at the trailing edges 42 and the convective cooling, provided to the overhang portion 68, additionally effecting the reduced strain at and/or near the location of the trailing edge corners 66, such as may occur during thermal cycles during operation of the gas engine 10.

An inner diameter endwall post-impingement cooling chamber 96 is located adjacent to the recess cavity 70, and the inner rail 56 is located axially between the recess cavity 70 and the post-impingement cooling chamber 96, as may be seen in FIGS. 3 and 5. The post-impingement cooling chamber 96 receives cooling air for cooling a portion of the endwall 40 corresponding to the location of the post-impingement cooling chamber 96, and for cooling the overhang portion 68. In the embodiment shown, cooling air enters the chamber 96 from an inner diameter seal housing 98 (FIG. 5) located radially inwardly from the endwall 40. At least a portion of the cooling air provided to the inner diameter seal housing 98 may be provided from the cooling air passing through the radially extending cooling channels 60 in the vanes 32. The cooling air from the inner diameter seal housing 98 enters the chamber 96 through impingement holes 100 formed in one or more impingement plates 102 associated with the post-impingement cooling chamber 96, which impingement plates 102 define a radially inner boundary for the post-impingement cooling chamber 96. A portion of the cooling air passing through the holes 100 impinges on an inner surface 104 of the endwall 40.

The cooling passages 94 extend axially through or past the inner rail 56 to the post-impingement cooling chamber 96. The cooling air metering through the impingement cooling holes 100, comprising post-impingement air, may pass into entry openings 106 of the cooling passages 94 and flow through the cooling passages 94 to exit openings 108 (FIGS. 4 and 5) at the downstream edge 54 of the endwall 40 to provide convective cooling to the overhang portion 68 of the endwall 40. The cooling air passing out the exit openings 108 may further provide convective cooling to the surfaces of the downstream edge 54. In addition, a portion of the post-impingement cooling air may be provided from the post-impingement cooling chamber 96 to cooling passages 110 (FIG. 3) at the upstream edge 52 of the endwall and to cooling passages (not shown) providing cooling to the mate faces at the lateral edges 48, 50 of the endwall 40.

It should be understood that, although the recess cavity 70 illustrating aspects of the present invention is shown as a rectangular cavity extending substantially the axial and circumferential extent of the overhang portion 68, other configurations of the recess cavity 70 may be provided. For example, the overhang portion 68 may be provided with one or more recess cavities configured or shaped to address particular structural rigidity and cooling requirements associated with a specific airfoil structure 30.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A component in a gas turbine engine comprising:

an airfoil extending radially outwardly from an endwall associated with said airfoil, said endwall extending between an upstream edge and a downstream edge and defining a cool side and a gas side;

a recess cavity defined in an overhang portion extending from a location adjacent to said downstream edge toward said upstream edge, said recess cavity extending radially into said overhang portion from said cool side toward said gas side and defining a cavity surface located a first distance into said endwall from a peripheral radially inner surface of said endwall;

a plurality of grooves extending radially into said cavity surface and having an elongated dimension extending in a direction from said downstream edge toward said upstream edge, said grooves including a groove bottom surface located a second distance radially into said endwall greater than said first distance; and cooling passages extending through said overhang portion and located:

between pairs of said grooves; and radially between said groove bottom surface and said cavity surface.

2. The component of claim 1, wherein said endwall includes opposing lateral sides extending in an axial direction between said upstream and downstream edges and said recess cavity extends circumferentially between said lateral sides of said endwall, and said plurality of grooves are spaced circumferentially across said recess cavity.

3. The component of claim 1, wherein said endwall comprises a radially inner endwall and includes an inner diameter endwall post-impingement cooling chamber located adjacent to said recess cavity, said cooling passages extending from said inner diameter endwall post-impingement cooling chamber to said downstream edge.

4. The component of claim 1, wherein a radially extending raised portion of said recess cavity, between each pair of grooves, includes one of said cooling passages.

5. The component of claim 3, including an inner rail extending generally circumferentially between said inner diameter endwall post-impingement cooling chamber and said recess cavity, and said cooling passages extend through said inner rail.

6. The component of claim 1, wherein said airfoil comprises a leading edge and a trailing edge, and said trailing edge of said airfoil is joined to said gas side of said endwall at an axial location aligned with a portion of said recess cavity.

7. A vane assembly for a gas turbine engine comprising:

an inner endwall extending between an upstream edge and a downstream edge, and defining a cool side and a gas side;

an outer endwall spaced radially outward of said inner endwall;

an airfoil extending from said inner endwall to said outer endwall, said airfoil including a leading edge and a trailing edge;

an inner rail extending generally circumferentially along said inner endwall and radially inwardly of said cool side of said inner endwall;

said inner endwall including an overhang portion extending axially from a location of said inner rail;

a recess cavity defined between said inner rail and said downstream edge, and extending radially into said overhang portion from said cool side toward said gas side and defining a cavity surface located a first distance into said inner endwall from a peripheral radially inner surface of said inner endwall;

a plurality of grooves extending radially into said cavity surface and having an elongated dimension extending in a direction from said inner rail toward said downstream edge, said grooves including a groove bottom surface located a second distance radially into said inner endwall greater than said first distance; and cooling passages extending through said overhang portion and located:

between pairs of said grooves;

radially between said groove bottom surface and said cavity surface.

8. The vane assembly of claim 7, wherein said endwall includes opposing lateral sides extending in an axial direction between said upstream and downstream edges and said recess cavity extends circumferentially between said lateral sides of said inner endwall, and said plurality of grooves are spaced circumferentially across said recess cavity.

9. The vane assembly of claim 7, wherein said inner endwall includes an inner diameter endwall post-impingement cooling chamber located adjacent to said recess cavity, said cooling passages extending from said inner diameter endwall post-impingement cooling chamber to said downstream edge.

10. The vane assembly of claim 7, wherein a radially extending raised portion of said recess cavity, between each pair of grooves, includes one of said cooling passages.

11. The vane assembly of claim 9, wherein said cooling passages extend through said inner rail.

12. The vane assembly of claim 7, wherein said trailing edge of said airfoil is joined to said gas side of said inner endwall at an axial location aligned with a portion of said recess cavity.

13. A component in a gas turbine engine comprising:

an airfoil extending radially outwardly from an endwall associated with said airfoil, said endwall extending between an upstream edge and a downstream edge and defining a cool side and a gas side;

a recess cavity defined in an overhang portion extending from a location adjacent to said downstream edge toward said upstream edge, said recess cavity extending radially into said overhang portion from said cool side toward said gas side and defining a cavity surface;

a plurality of grooves extending radially into said cavity surface and having an elongated dimension extending in a direction from said downstream edge toward said upstream edge; and cooling passages extending through:

said overhang portion; and radially extending raised portions of said recess cavity located between respective pairs of grooves.

14. The component of claim 13, wherein said endwall includes opposing lateral sides extending in an axial direction between said upstream and downstream edges and said recess cavity extends circumferentially between said lateral sides of said endwall, and said plurality of grooves are spaced circumferentially across said recess cavity.

15. The component of claim 13, wherein said endwall comprises a radially inner endwall and includes an inner diameter endwall post-impingement cooling chamber located adjacent to said recess cavity, said cooling passages extending from said inner diameter endwall post-impingement cooling chamber to said downstream edge.

16. The component of claim 15, including an inner rail extending generally circumferentially between said inner diameter endwall post-impingement cooling chamber and said recess cavity, and said cooling passages extend through said inner rail.

17. The component of claim 13, wherein said cavity surface is located a first distance into said endwall from a peripheral radially inner surface of said endwall, and said grooves include a groove bottom surface located a second distance radially into said endwall greater than said first distance.

18. The component of claim 17, wherein said cooling passages are located:

between pairs of said grooves; and radially between said groove bottom surface and said cavity surface.

* * * * *